US006948838B2

(12) United States Patent
Künstler

(10) Patent No.: US 6,948,838 B2
(45) Date of Patent: Sep. 27, 2005

(54) VEHICLE LAMP HAVING PRISMATIC ELEMENT

(75) Inventor: Rolf Künstler, Eisenach (DE)

(73) Assignee: FER Fahrzeugelektrik GmbH, Eisenach (DE)

( * ) Notice: Subject to any disclaimer, the term of this patent is extended or adjusted under 35 U.S.C. 154(b) by 121 days.

(21) Appl. No.: 10/339,632

(22) Filed: Jan. 10, 2003

(65) Prior Publication Data

US 2005/0065798 A1 Mar. 24, 2005

(30) Foreign Application Priority Data

Jan. 15, 2002 (DE) ..... 202 00 571 U

(51) Int. Cl.[7] ..... F21S 8/10

(52) U.S. Cl. ..... 362/545; 362/520; 362/237; 362/245

(58) Field of Search ..... 362/545, 520, 362/237, 245, 241, 243, 23, 29, 551, 555, 487, 509, 511, 516, 543, 544, 227, 242, 235, 236, 244, 257, 296, 307, 308, 317, 326, 327, 341, 343, 800, 459

(56) References Cited

U.S. PATENT DOCUMENTS

| | | | | | |
|---|---|---|---|---|---|
| 2,672,841 | A | * | 3/1954 | Nitzberg | 362/511 |
| 4,642,737 | A | * | 2/1987 | Meyers, Jr. | 362/511 |
| 4,698,730 | A | * | 10/1987 | Sakai et al. | 362/311 |
| 4,929,866 | A | * | 5/1990 | Murata et al. | 362/545 |
| 5,349,504 | A | * | 9/1994 | Simms et al. | 362/555 |
| 5,438,495 | A | * | 8/1995 | Ahlen et al. | 362/299 |
| 5,481,440 | A | * | 1/1996 | Oldham et al. | 362/555 |
| 5,490,049 | A | | 2/1996 | Montalan et al. | |
| 5,707,130 | A | * | 1/1998 | Zwick et al. | 362/517 |
| 5,769,532 | A | * | 6/1998 | Sasaki | 362/237 |
| 6,356,394 | B1 | * | 3/2002 | Glienicke | 362/511 |
| 6,461,028 | B1 | * | 10/2002 | Huang | 362/505 |
| 6,508,576 | B2 | * | 1/2003 | Emmelmann et al. | 362/543 |
| 6,598,998 | B2 | * | 7/2003 | West et al. | 362/307 |
| 6,623,132 | B2 | * | 9/2003 | Lekson et al. | 362/31 |
| 6,623,152 | B1 | * | 9/2003 | Kroening | 362/555 |

FOREIGN PATENT DOCUMENTS

| | | |
|---|---|---|
| DE | 195 07 234 A1 | 9/1996 |
| DE | 199 40 410 A1 | 3/2001 |

* cited by examiner

*Primary Examiner*—John Anthony Ward
*Assistant Examiner*—Ismael Negron
(74) *Attorney, Agent, or Firm*—Sughrue Mion, PLLC

(57) ABSTRACT

A vehicle side-flashing lamp includes: a cup-shaped housing; a light exit opening opposite the housing bottom; and a light exit cover which covers the light exit opening. At least one light-emitting diode emits light outwardly at least partially at an angle which is large with respect to the main axis of the housing. A prismatic element, defined by first, second and third boundary surfaces, is arranged in front of the light-emitting diode in such a way that an emitted light beam passes through the first boundary surface into the prismatic element and is at least partially reflected at the second boundary surface, which is inclined with respect to the central axis of the light beam, in such a way that the reflected part issues from the prismatic element through the third boundary surface.

18 Claims, 2 Drawing Sheets

VEHICLE LAMP HAVING PRISMATIC ELEMENT

BACKGROUND OF THE INVENTION

The invention concerns a vehicle lamp, in particular a side flashing lamp for motor vehicles, as set forth in the classifying portion of claim 1.

A vehicle lamp of that kind is known from German utility model No 297 20 060, which is to be used as a flashing lamp which is mounted laterally to a motor vehicle and in which, besides the emission of light in the transverse direction of the vehicle, there is also a need for light to be emitted in the longitudinal direction of the vehicle, in particular rearwardly but also forwardly.

In that respect the problem arises that the light emitted by the light emitting diodes used as the light source is to be radiated into a spatial angle embracing nearly 180° from a cup-shaped housing whose substantially flat light exit opening is disposed in an also substantially flat surface of the vehicle body and facing in the transverse direction of the vehicle, and is covered over by a substantially flat light exit cover.

A similar problem can also arise in relation to other vehicle lamps which are not used as side flashing lamps. In that case for example the main light emission direction which is actually predetermined by the cup-shaped housing can also face forwardly or rearwardly in the direction of travel and additional light radiation may be required in one or both transverse directions.

To resolve that problem the state of the art proposes arranging a plurality of light emitting diodes on respective separate carrier boards which are inclined at an acute angle with respect to the main axis of the housing, which is perpendicular to the plane of the light exit opening, so that the carrier boards form inclinedly outwardly projecting ramps on which a respective light emitting diode is mounted by way of the free ends which project beyond the light exit opening, in such a way that the main axis of the light beam emitted by the light emitting diode extends substantially perpendicularly to the inclined direction in which the ramp extends. At least one further light emitting diode is so arranged that the main axis of the light beam emitted thereby extends substantially parallel to the main axis of the housing. By virtue of suitable orientation of the ramps the light emitting diodes disposed thereon then emit light substantially in the direction of travel inclinedly rearwardly while the emission direction of the last-mentioned at least one light emitting diode is in transverse relationship to the direction of travel. In order also to be able to emit light forwardly in the direction of travel with that arrangement a further group of ramps is required, with light emitting diodes mounted thereon, which are of an orientation in opposite relationship to the other ramps.

A disadvantage with that known arrangement is the extremely complex structure of the boards which carry the individual light emitting diodes and which have to be mounted in individually supported relationship on a main board in order to implement the wiring of the light emitting diodes.

SUMMARY OF THE INVENTION

In comparison the object of the invention is to develop a vehicle lamp of the kind set forth in the opening part of this specification, in such a way that it can be produced in a substantially easier and less expensive manner.

To attain that object the invention provides the features recited in claim 1.

By virtue of the fact that a prismatic element is placed in front of each light emitting diode in such a way that the light coming from the light emitting diode and entering through a first boundary surface impinges on a second boundary surface which is inclined with respect to the principal ray of the light beam and by which at least a part of the light beam is deflected by reflection, the light of that light emitting diode can be emitted at an angle which is large with respect to the original emission direction, if it issues from the prismatic element again through a third boundary surface. That means however that it is no longer necessary for the light emitting diodes to be mounted on ramps which project inclinedly outwardly in order to achieve a light emission direction which differs greatly from the main axis of the housing. In particular a differing orientation of various prismatic elements which are associated with various light emitting diodes means that it is possible to achieve light emission in any directions which are disposed transversely with respect to the main axis of the housing, and possibly also panoramic light emission.

In terms of the side flashing lamp referred to in the opening part of this specification, this means that a very simple structure permits light emission not only in the transverse direction of the vehicle but also forwardly and rearwardly in the direction of travel.

The plurality of prismatic elements which are associated with a plurality of light emitting diodes can be integrally connected together and thus form an intermediate light cover or panel which is arranged between a flat board which carries all the light emitting diodes and which permits particularly simple wiring for and power supply to the light emitting diodes and the light exit cover extending in substantially parallel relationship with that board.

In order to permit light emission in directions which include an angle of nearly 90° with the main axis of the housing, a particularly preferred embodiment provides that the prismatic elements at least with their tips project outwardly beyond the light exit opening and are covered by an outwardly convexly curved light exit cover.

Very widely varying light and intensity distribution effects can be achieved by a differing configuration in respect of the three boundary surfaces of the prismatic elements, with which the light beam respectively passing therethrough interacts.

These and further advantageous configurations of a vehicle lamp according to the invention are set forth in the appendant claims.

BRIEF DESCRIPTION OF THE DRAWING

The invention is described hereinafter by means of an embodiment with reference to the drawing in which.

DETAILED DESCRIPTION OF THE INVENTION

Figure 1:
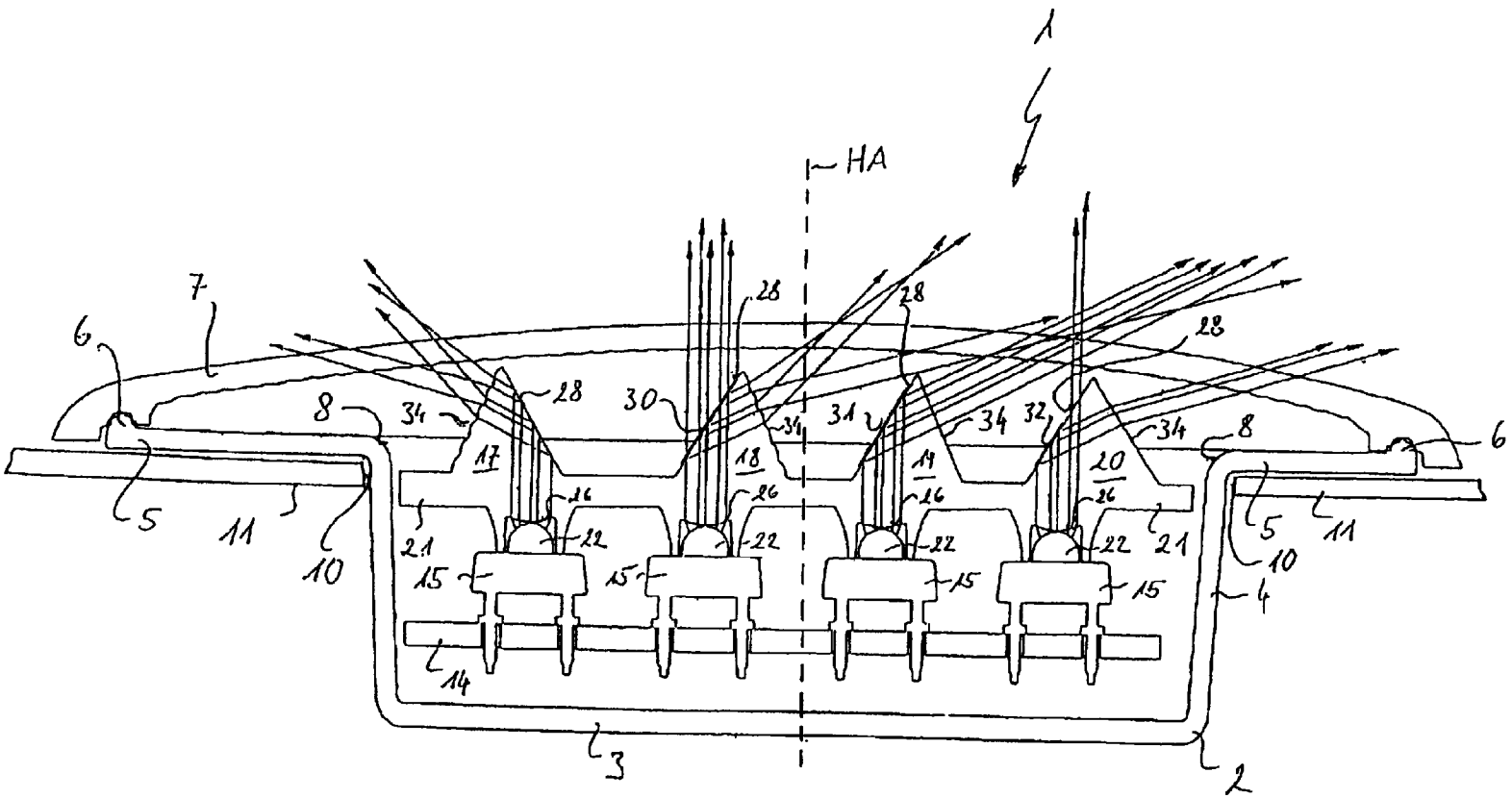
FIG. 1 is a diagrammatic side view through a vehicle lamp according to the invention which includes a plurality of light emitting diodes, each of which has associated therewith a respective prismatic element having a function differing from the other prismatic elements.

Referring to FIG. 1, diagrammatically shown therein is a vehicle lamp 1 according to the invention which has a cup-shaped housing 2 including a housing bottom 3, a housing wall 4 which extends substantially perpendicularly to the housing bottom 3 and encloses the periphery thereof, a mounting flange 5 which adjoins the upper edge of the housing wall 4 and extends in an annular configuration therearound, and a light exit cover 7 which is sealingly connected to the outer edge 6 of the mounting flange 5 and which closes the housing in an outward direction. The upper edge of the housing wall 4 defines a light exit opening 8 from which the light exit cover 7 is at a spacing, by virtue of its flat, dome-shaped curvature, in the direction of the main axis HA of the housing, which extends substantially perpendicularly both with respect to the housing bottom 3 and also with respect to the light exit cover 7.

The housing 2 is fitted from the exterior into an opening 10 in the vehicle bodywork in such a way that the mounting flange 5 bears flat against the outside of the vehicle body panel 11. The fixing means for the vehicle lamp 1 and the sealing means required for sealing off the opening 10 in the vehicle body are not shown for the sake of enhanced clarity of the drawing. However it will be clear to the man skilled in the art how such means are designed and can be used in conjunction with a vehicle lamp 1 according to the invention.

Shown in the interior of the housing 2 are four light emitting diodes 15 which are mounted on a common carrier board 14 and which are so arranged that the main or central axes of the divergent light beams emitted by the light emitting diodes extend in substantially parallel relationship with each other and with respect to the main axis HA of the housing 2. Associated with each of the light emitting diodes 15 is a prismatic element 17 through 20. The illustrated prismatic elements 17 through 20 have different optical properties so that they provide different influences for the light beam emitted by the respectively associated light emitting diode 15, as will be described in greater detail hereinafter. It should be pointed out that in general prismatic elements which differ in that way are not used in one and the same vehicle lamp, although this is possible in principle. The prismatic elements 17 through 20 are connected together by flat connecting limbs or webs so that they form an integral intermediate light cover 21. That intermediate light cover 21 is arranged in the interior of the housing 2 beneath the housing edge forming the light exit opening 8, in substantially parallel relationship with respect to the housing edge, in such a way that the tips of the prismatic elements 17 through 20 project beyond it outwardly, that is to say through the light exit opening 8 outwardly to just below the curved light exit cover 7.

Figure 2:
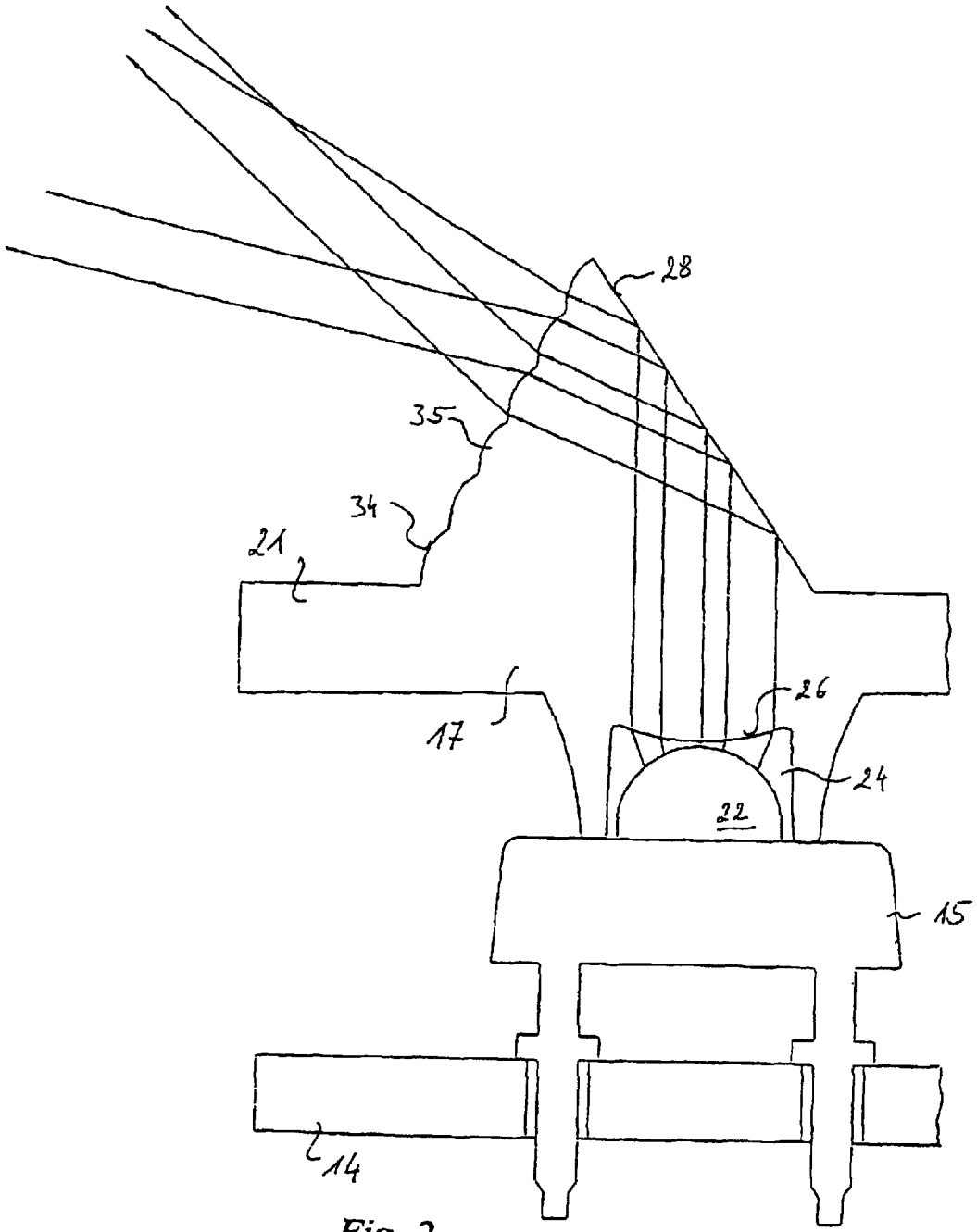
FIG. 2 is a view on a greatly enlarged scale showing the left-hand light emitting diode of FIG. 1 with the associated prismatic element.

Each of the light emitting diodes 15 has a hemispherical transparent dome 22 from which the light produced by the light emitting diode issues in the form of a divergent beam. As can be seen in particular from FIG. 2 each of the prismatic elements 17 through 20 has, at its side towards the associated light emitting diode 15, a bowl-like recess 24 into which the dome 22 of the light emitting diode 15 projects. The bottom surface of each bowl-like recess 24 forms a first boundary surface 26 through which the light beam from the light emitting diode 15 passes into the interior of the transparent prismatic element 17 through 20.

In the illustrated embodiments of various prismatic elements 17 through 20 the first boundary surface 26 in each case is in the form of a converging lens in such a way that it renders parallel the divergent light beam from the associated light emitting diode 15. This is a particularly preferred embodiment. As an alternative thereto the first boundary surface acting as the converging lens can however also only reduce the flare angle of the light beam or even produce a convergent light beam. If desired the first boundary surface can also be flat, that is to say optically inactive, or it may be such that it still further increases the divergence of the light beam passing therethrough.

After passing through the first boundary surface 26 the light beam reaches a second flat boundary surface 28 which is inclined relative to the main axis of the light beam and at which the light beam is at least partially reflected.

That can be achieved either by total reflection (prismatic element 17) or by virtue of the fact that the second boundary surface 28 carries on the outside a mirror layer which, as is shown in FIG. 1 in respect of the prismatic element 18, is partially transmissive (mirror layer 30) or, as in the case of the prismatic elements 19 and 20, acts as a complete mirror (mirror layers 31 and 32 respectively). It will be noted however that in the case of the prismatic element 20 the mirror layer 32 extends only over a part of the beam cross-section so that the part of the light beam in question, which is at the right in FIG. 1, passes through the second boundary surface 28 of the prismatic element 20 straight and practically without being attenuated.

As in regard to the total reflection illustrated in respect of the prismatic element 17 the total reflection angle also depends on the refractive index of the material used for the prismatic element, the angle of inclination of the second boundary surface 28 and thus the deflection angle of the light beam can be selected within wide limits, by virtue of a suitable choice of materials with differing refractive indices.

The light reflected by the second boundary surface 28 of each prismatic element 17 through 20 issues from the prismatic element through a third boundary surface 34 which, as is shown in respect of the prismatic elements 17 and 18, has an optically effective structure 35 which, in the illustrated examples, has the effect of a diffusing lens. It is however also possible here to provide other optically effective structures which for example increase or reduce the flare angle of the issuing light beam.

As an alternative thereto the third boundary surface 34 may be optically inactive and the light passing therethrough can be uninfluenced.

As shown in FIG. 1 the light exit cover 7 may be provided either with or without an optically effective structure so that for example it produces additional diffusion of the light.

What is claimed is:

1. A vehicle lamp including a cup-shaped housing having a housing bottom for installation in an opening in a bodywork of a vehicle, a light exit opening in opposite relationship to the housing bottom, a light exit cover which covers over the light exit opening and closes the housing in an outward direction, at least one light emitting diode arranged in the interior of the housing and operable to emit a light beam the main axis of which extends substantially parallel with respect to the main axis of the housing which extends from the housing bottom to the light exit opening, and a prismatic element defined by first, second and third boundary surfaces and arranged in front of the at least one light emitting diode in such a way that said light beam emitted by the light emitting diode passes through the first boundary surface into the prismatic element and is at least partially reflected at the second boundary surface which is flat and is inclined with respect to the central axis of the light beam in such a way that the reflected part directly reaches the third boundary surface through which it exits the prismatic element and passes directly through said light exit cover in a direction which is disposed transversely with respect to the main axis of the housing but includes an angle of less than 90° therewith.

2. A vehicle lamp as set forth in claim 1 wherein the second boundary surface of the prismatic element carries on its outside a layer which is partially transmissive for light so that the impinging light beam is broken down into first and second partial light beams of which one passes straight through the second boundary surface while the other is deflected by reflection through an angle predetermined by the inclination of the second boundary surface.

3. A vehicle lamp as set forth in claim 1 including an opaque mirror layer on the outside of the second boundary surface.

4. A vehicle lamp as set forth in claim 1 including an opaque mirror layer on the outside of the second boundary surface, the mirror layer extending only over a part of the cross-section of the light beam.

5. A vehicle lamp as set forth in claim 1 wherein the second boundary surface of the prismatic element is unmirrored but is so inclined relative to the main axis of the light beam impinging thereon that the light beam is deflected by total reflection through an angle predetermined by the inclination of the second boundary surface and by the refractive index of the material of the prismatic element.

6. A vehicle lamp as set forth in claim 1 wherein the third boundary surface has an optically effective structure operable to change the intensity distribution at least of a part of the light beam reflected at the second boundary surface.

7. A vehicle lamp as set forth in claim 1 wherein the third boundary surface of the prismatic element has an optically effective structure operable to change the flare angle of the light beam reflected at the second boundary surface.

8. A vehicle lamp as set forth in claim 1 wherein the third boundary surface of the prismatic element is optically inactive to allow light to pass therethrough substantially unchanged.

9. A vehicle lamp as set forth in claim 1 wherein the light exit cover is arranged at a spacing from the light exit opening of the housing and the at least one prismatic element is arranged within the light exit cover and projects outwardly beyond the light exit opening.

10. A vehicle lamp as set forth in claim 1 wherein the first boundary surface of the prismatic element is optically active to change the flare angle of the light beam coming from the light emitting diode and passing through the first boundary surface.

11. A vehicle lamp as set forth in claim 10 wherein the first boundary surface is operable as a converging lens.

12. A vehicle lamp as set forth in claim 11 wherein the first boundary surface is operable to render substantially parallel the light beam coming from the light emitting diode.

13. A vehicle lamp as set forth in claim 1 including a plurality of light emitting diodes so arranged that the central axes of the light beams emitted thereby are inclined at most by small angles with respect to the main axis of the housing, and a prismatic element associated with each light emitting diode.

14. A vehicle lamp as set forth in claim 13 including connecting means integrally connecting prismatic elements of the plurality of light emitting diodes together to form an intermediate light cover.

15. A vehicle lamp as set forth in claim 13 wherein the plurality of light emitting diodes are arranged in a plurality of mutually parallel rows.

16. A vehicle lamp as set forth in claim 13 including a common carrier board carrying the plurality of light emitting diodes.

17. A vehicle lamp as set forth in claim 16 wherein the common carrier board extends substantially perpendicularly to the main axis of the housing in the proximity of the housing bottom.

18. A vehicle lamp including a cup-shaped housing having a housing bottom for installation in an opening in a bodywork of a vehicle, a light exit opening in opposite relationship to the housing bottom, a light exit cover which covers over the light exit opening and closes the housing in an outward direction, at least one light emitting diode arranged in the interior of the housing and operable to emit a light beam the main axis of which extends substantially parallel with respect to the main axis of the housing which extends from the housing bottom to the light exit opening, and a prismatic element defined by first, second and third boundary surfaces and arranged in front of the at least one light emitting diode in such a way that said light beam emitted by the light emitting diode passes through the first boundary surface into the prismatic element and is at least partially reflected at the second boundary surface which is inclined with respect to the central axis of the light beam in such a way that the reflected part directly reaches the third boundary surface and passes directly through said light exit cover in a direction which is disposed transversely with respect to the main axis of the housing but includes an angle of less than 90° therewith, wherein the light exit cover is optically inactive to allow light to pass therethrough substantially unchanged.

* * * * *